US009019253B2

(12) United States Patent
Drzaic

(10) Patent No.: US 9,019,253 B2
(45) Date of Patent: Apr. 28, 2015

(54) METHODS AND SYSTEMS FOR ADJUSTING COLOR GAMUT IN RESPONSE TO AMBIENT CONDITIONS

(75) Inventor: Paul Stephen Drzaic, Morgan Hill, CA (US)

(73) Assignee: Apple Inc., Cupertino, CA (US)

( * ) Notice: Subject to any disclaimer, the term of this patent is extended or adjusted under 35 U.S.C. 154(b) by 149 days.

(21) Appl. No.: 13/599,832

(22) Filed: Aug. 30, 2012

(65) Prior Publication Data

US 2014/0063039 A1 Mar. 6, 2014

(51) Int. Cl.
*G09G 5/00* (2006.01)
*G09G 5/02* (2006.01)

(52) U.S. Cl.
CPC ..... *G09G 5/02* (2013.01)

(58) Field of Classification Search
None
See application file for complete search history.

(56) References Cited

U.S. PATENT DOCUMENTS 5,956,015 A * 9/1999 Hino ..... 345/600
7,619,598 B2 11/2009 Pulvirenti et al.
7,800,559 B2 9/2010 Weitbruch et al.
2006/0284895 A1* 12/2006 Marcu et al. ..... 345/690
2008/0204438 A1 8/2008 Song et al.
2008/0303918 A1 12/2008 Keithley
2009/0041341 A1* 2/2009 Scheibe ..... 382/162
2009/0278774 A1 11/2009 Chen et al.
2010/0073340 A1* 3/2010 Morimoto ..... 345/207
2010/0201275 A1 8/2010 Cok et al.
2010/0225806 A1* 9/2010 Hsu et al. ..... 348/453
2011/0115835 A1 5/2011 Lee
2011/0205259 A1* 8/2011 Hagood, IV ..... 345/690
2011/0221720 A1 9/2011 Kuo et al.
2013/0222408 A1* 8/2013 Lee et al. ..... 345/589

* cited by examiner

*Primary Examiner* — William Boddie
*Assistant Examiner* — Bipin Gyawali
(74) *Attorney, Agent, or Firm* — Fletcher Yoder PC

(57) ABSTRACT

Systems and methods for adjusting a color space of a display. In one embodiment, the method for adjusting the color space of the display may include receiving image data to be rendered on the display and receiving an indication of an amount of ambient light impinging on the display. The method may then include rendering the image data in a first color space when the amount of ambient light is less than a threshold. Alternatively, the method may include rendering the image data in an expanded color space when the amount of ambient light is not less than the threshold. As such, the expanded color space may compensate for one or more color shifts in the image data caused by the ambient light.

5 Claims, 4 Drawing Sheets

METHODS AND SYSTEMS FOR ADJUSTING COLOR GAMUT IN RESPONSE TO AMBIENT CONDITIONS

BACKGROUND

The present disclosure relates generally to displays for electronic devices and, more specifically, to adjusting a color gamut of the displays in various ambient lighting environments.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Organic light emitting diode (OLED) displays are self-emissive, in that the amount of light emitted from any subpixel in the displays depend on an amount of current passing through a light emitting diode in that subpixel. As a result, OLED displays work without a backlight, which enable them to display deep black levels, high contrast, and bright colors. Further, OLED displays have fast response times and result in displays that are thinner and lighter than a liquid crystal display (LCD).

In a dark environment, an OLED display viewer generally sees the colors emitted by the display, as the colors were intended to be perceived. However, as the amount of ambient light striking the display increases, some of the ambient light is reflected from the display itself into a viewer's eyes. For instance, the ambient light may be reflected by a front surface of the display, any metallic or conducting layers within the display, interfaces within the display in which a refractive index in one layer is different from a refractive index in an adjacent layer, and the like.

In very bright environments, the amount of light reflected from the display can significantly reduce the perceived light emitted from the display and can lower the contrast of the display. Additionally, the amount of light reflected from the display can reduce the color saturation of the display. Since the reflected light will tend to be neutral in coloration, colored areas of the display will effectively have some amount of white added to those areas, which leads to desaturation. Due to the decreased color saturation, along with the decreased image contrast, in bright ambient lighting conditions, it may be difficult to discern the image being displayed on the OLED display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to OLED displays that may be designed to have a large color gamut that may be capable of rendering colors that are more saturated than those specified by a smaller red, green, and blue color space (i.e., sRGB). In one embodiment, an electronic device may determine whether an amount of ambient light received by the display may exceed some ambient lighting threshold. If the amount of ambient light exceeds the ambient lighting threshold, the display may expand its color space based on the amount of ambient light. The display may then adjust the colors rendered by the display out towards saturated values in the expanded color space based on the amount of ambient light received by the display. As a result, the colors depicted in the display and observed by a viewer may be closer to the intended values in the ambient light environment.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is directed to systems, displays, and methods for expanding color space in an Organic Light Emitting Diode (OLED) display or a liquid crystal display (LCD) to improve the discernibility of images depicted on the display in various ambient light environments. In one embodiment, a controller in communication with the OLED display may receive a measurement of ambient light that may be impinging on the OLED display. Based on the measurement of ambient light received by the controller, the controller may expand the color space of images depicted on the OLED display to compensate for color distortion caused by the ambient light reflecting off of the OLED display and into a viewer's eyes. As a result, the viewer may view images on the OLED display such that the images look substantially similar to as they would be seen in areas with little or no ambient lighting.

Figure 1:
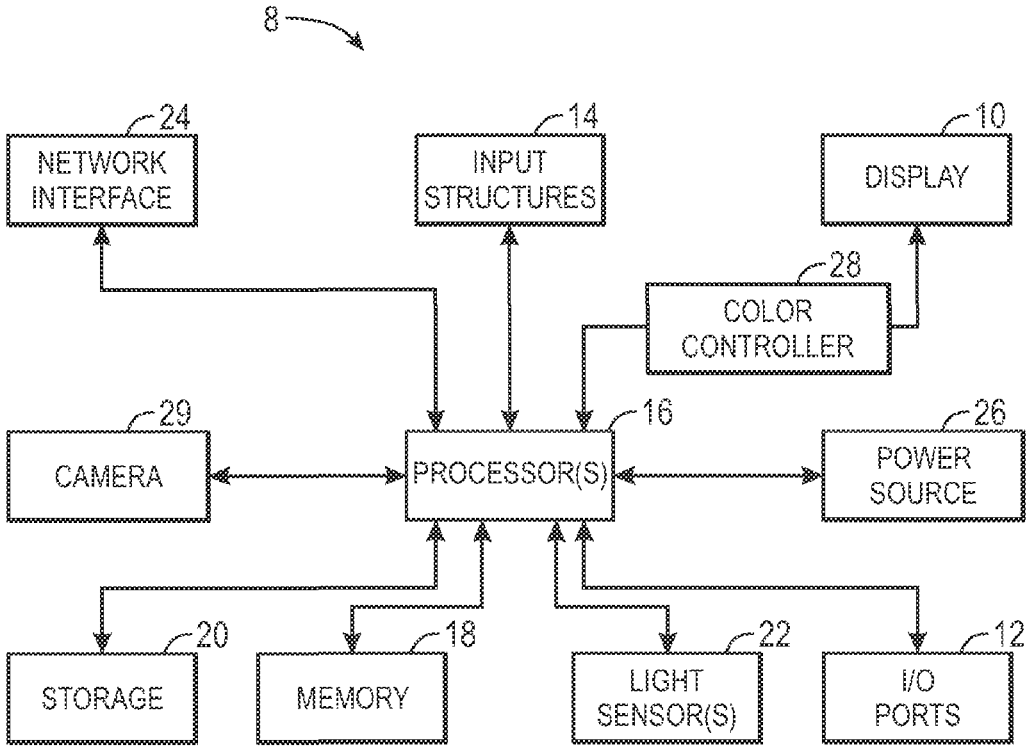
FIG. 1 is a block diagram of exemplary components of an electronic device, in accordance with an embodiment.

A variety of electronic devices may incorporate displays that can adaptively adjust color space according to ambient conditions. An example of a suitable electronic device may include various internal and/or external components, which contribute to the function of the device. FIG. 1 is a block diagram illustrating the components that may be present in such an electronic device 8 and which may allow the device 8 to function in accordance with the methods discussed herein. Those of ordinary skill in the art will appreciate that the various functional blocks shown in FIG. 1 may include hardware elements (including circuitry), software elements (including computer code stored on a computer-readable medium) or a combination of both hardware and software elements. It should further be noted that FIG. 1 is merely one example of a particular implementation and is merely intended to illustrate the types of components that may be present in a device 8. For example, in the presently illustrated embodiment, these components may include a display 10, I/O ports 12, input structures 14, one or more processors 16, a memory device 18, a non-volatile storage 20, one or more light sensors 22, a networking device 24, a power source 26, a color controller 28, and a camera 29.

With regard to each of these components, the display 10 may be used to display various images generated by the device 8. The display 10 may be an organic light emitting diode (OLED) display. An OLED display may include a number of pixels or picture elements that may be used to depict images on the display 10. In an OLED display, each pixel may be composed of three pixel components, known as subpixels, that may depict red, green, and blue colors, respectively. Each OLED subpixel may depict is respective color using an emissive electroluminescent layer (i.e., film of organic compound) which emits light in response to an electric current. By using the emissive electroluminescent layer, each OLED subpixel may be capable of producing colors in a wider color gamut, as compared to many liquid crystal displays. Alternatively, an OLED display may be constructed with a white emitter layer, in conjunction with color filters to provide the color at each subpixel (R, G, B). More commonly, four subpixels may be used in this type OLED display—Red, Green, Blue, and White (i.e., white having no color filter, and simply emits white light). Although this disclosure is directed primarily to OLED displays for this reason, the systems, devices, and methods of this disclosure may employ alternatively LCDs capable of such wider color gamuts.

The I/O ports 12 may include ports configured to connect to a variety of external devices, such as a power source, headset or headphones, or other electronic devices 8 (such as handheld devices and/or computers, printers, projectors, external displays, modems, docking stations, and so forth). The input structures 14 may include the various devices, circuitry, and pathways by which user input or feedback is provided to the processor 16. Such input structures 14 may be configured to control a function of the device 8, applications running on the device 8, and/or any interfaces or devices connected to or used by the electronic device 8.

The processor(s) 16 may provide the processing capability to execute the operating system, programs, user and application interfaces, and any other functions of the electronic device 8. The instructions or data to be processed by the processor(s) 16 may be stored in a computer-readable medium, such as a memory 18. Such a memory 18 may be provided as a volatile memory, such as random access memory (RAM), and/or as a non-volatile memory, such as read-only memory (ROM). The components may further include other forms of computer-readable media, such as a non-volatile storage 20, for persistent storage of data and/or instructions. The non-volatile storage 20 may include flash memory, a hard drive, or any other optical, magnetic, and/or solid-state storage media. The non-volatile storage 20 may be used to store firmware, data files, software, wireless connection information, and any other suitable data.

The embodiment illustrated in FIG. 1 may also include one or more light sensors 22. The light sensors 22 may include sensors such as photodetectors, photo diodes, photo resistors, photocells, or any other sensor capable of detecting ambient light. In various embodiments, the light sensors 22 may be disposed in the substrate such that they receive light from the direction of the substrate, the direction opposite the substrate, or both. In one embodiment, the camera 29 may be used for detecting ambient light in addition to capturing digital images.

The components depicted in FIG. 1 also include a network device 24, such as a network controller or a network interface card (NIC). The network device 24 may be a Wi-Fi device, a radio frequency device, a Bluetooth® device, a cellular communication device, or the like. The network device 24 may allow the electronic device 8 to communicate over a network, such as a Local Area Network (LAN), Wide Area Network (WAN), or the Internet. Further, the components may also include a power source 26 such as a battery or AC power.

Referring now to the color controller 28, the color controller 28 may control the color space in which images may be depicted on the display 10. That is, the color controller 28 may expand or contract the color space of the images depicted on the display 10. For example, the color controller 28 may depict images on the display 10 in a common color space (e.g., sRBG, ProPhoto RGB, YIQ, YUV, YPbPr, YCbCr, xvYCC, BT.601, and BT.709), an expanded color space (e.g., Adobe® RGB color space), and the like. In one embodiment, the display 10 (e.g., OLED displays) may be designed to have an exceptionally large color gamut such as the color gamut of the Adobe® RGB color space. The Adobe® RGB color space is a well-recognized color space that includes a larger color gamut than the smaller color space (sRGB). In particular, the Adobe® RGB color space includes a much greater gamut in the green and some enhanced gamut in the blue and red regions, as compared to the smaller color space (sRGB). In one embodiment, OLED displays may render colors very close to the limits within the Adobe® RGB color space, but since many sources of electronic image content is designed to depict images in the smaller (sRGB) color space, rendering images that are designed in sRGB colors within the Adobe® RGB color space may result in unrealistic coloration. However, it may be useful to render colors more saturated than specified colors in the smaller color space (sRGB) in various situations.

For instance, in very bright environments (i.e., high ambient light), a portion of the ambient light impinging on the display 10 may reflect off the display 10 and alter how the colors depicted in the display 10 may be viewed. That is, the reflected ambient light may become a significant fraction of the light emitted from the display 10 such that the reflected ambient light may lower the contrast of the display 10 and depict dark areas of images lighter than their specified color. Alternatively, the reflected ambient light may reduce the color saturation of the display 10 since the reflected ambient light tends to be neutral in coloration. In this case, the colored areas of the images depicted in the display 10 will effectively have some amount of white added to those areas, which may desaturate the depicted images.

To compensate for the effects caused by ambient light reflecting off the display 10, the color controller 28 may adjust the color space in which the images depicted on the display 10 are displayed based on the amount of ambient light that is received by the display 10. As such, the depicted images in the display 10 may more accurately represent their intended colors. In one embodiment, the color controller 28 may receive ambient light measurements from the light sensors 22 to determine the amount of ambient light that is received by the display 10. Based on the ambient light measurements, the color controller 28 may adjust the color space of the images depicted in the display 10 to compensate for the ambient light reflected off the display 10. The resulting images depicted on the display 10 and viewed by a user may have colors that more closely represent the intended colors of the images despite the presence of the ambient light. Additional details with regard to the color controller 28 will be discussed below with reference to FIGS. 4-7.

Figure 2:
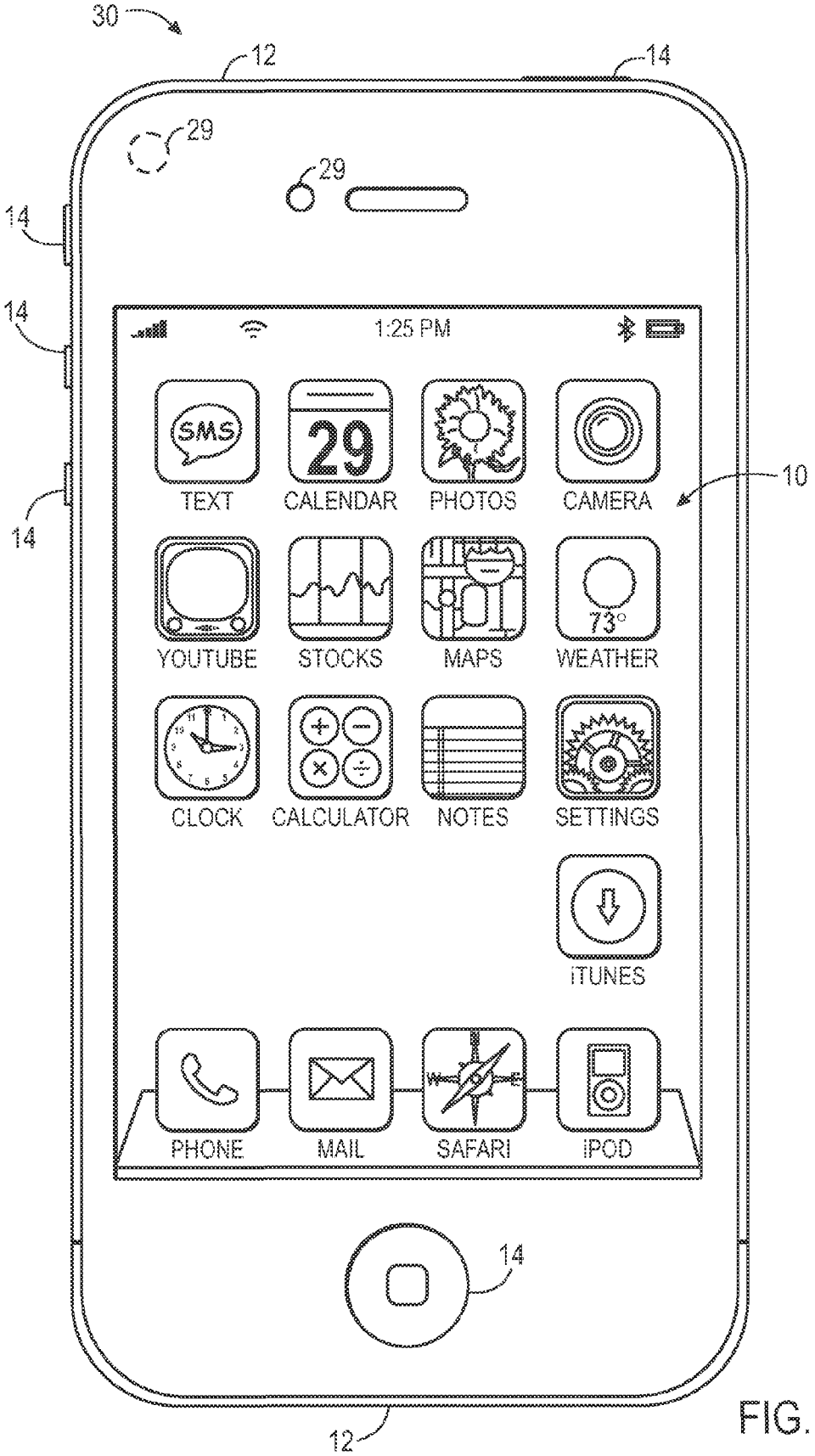
FIG. 2 is a front view of a handheld electronic device in accordance with an embodiment.

With the foregoing in mind, FIG. 2 illustrates an electronic device 8 in the form of a handheld device 30, here a cellular telephone. It should be noted that while the depicted handheld device 30 is provided in the context of a cellular telephone, other types of handheld devices (such as media players for playing music and/or video, personal data organizers, handheld game platforms, and/or combinations of such devices) may also be suitably provided as the electronic device 8. As discussed with respect to the general electronic device 8 of FIG. 1, the handheld device 30 may allow a user to connect to and communicate through the Internet or through other networks, such as local or wide area networks. The handheld electronic device 30, may also communicate with other devices using short-range connections, such as Bluetooth and near field communication. By way of example, the handheld device 30 may be a model of an iPod®, iPad®, or iPhone® available from Apple Inc. of Cupertino, Calif.

The handheld device 30 includes an enclosure or body that protects the interior components from physical damage and shields them from electromagnetic interference. The enclosure may be formed from any suitable material such as plastic, metal or a composite material and may allow certain frequencies of electromagnetic radiation to pass through to wireless communication circuitry within the handheld device 30 to facilitate wireless communication. In the depicted embodiment, the enclosure includes user input structures 14 through which a user may interface with the device. Each user input structure 14 may be configured to help control a device function when actuated.

In the depicted embodiment, the handheld device 30 includes a display 10 in the form of an OLED or an LCD that can display colors in the sRGB color gamut as well as the Adobe® color gamut. The display 10 may be used to display a graphical user interface (GUI) that allows a user to interact with the handheld device 30. The handheld electronic device 30 also may include various input and output (I/O) ports 12 that allow connection of the handheld device 30 to external devices such as a port that allows the transmission and reception of data or commands between the handheld electronic device 30 and another electronic device.

Figure 3:
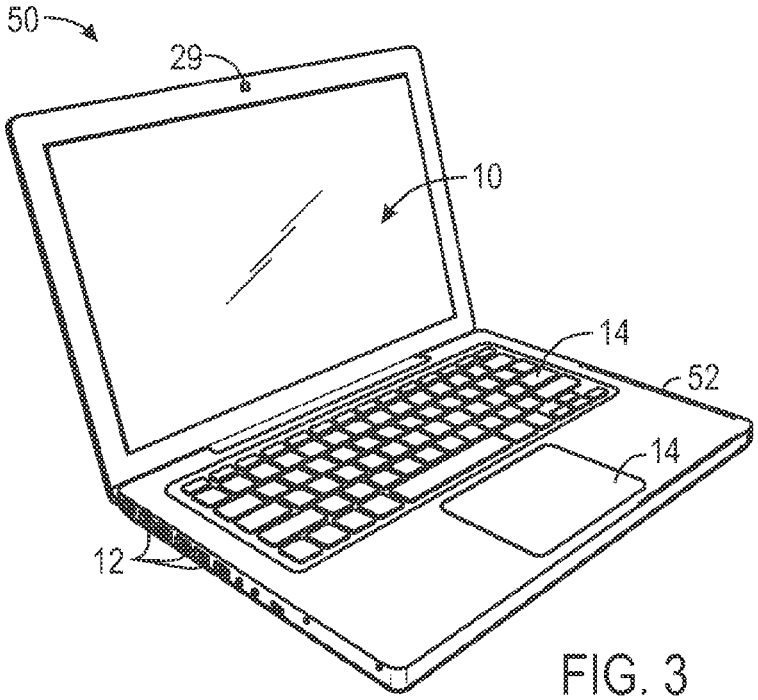
FIG. 3 is a view of a computer in accordance with an embodiment.

In addition to handheld devices 30, such as the depicted cellular telephone of FIG. 2, an electronic device 8 may also take the form of a computer or other type of electronic device. Such computers may include computers that are generally portable (such as laptop, notebook, and tablet computers) as well as computers that are generally used in one place (such as conventional desktop computers, workstations, and/or servers). In certain embodiments, the electronic device 8 in the form of a computer may be a model of a MacBook®, MacBook® Pro, MacBook Air®, iMac®, Mac® mini, iPad® or Mac Pro® available from Apple Inc. By way of example, an electronic device 8 in the form of a laptop computer 50 is illustrated in FIG. 3 in accordance with one embodiment. The depicted computer 50 includes a housing 52, a display 10, input structures 14, and input/output ports 12.

In one embodiment, the input structures 14 (such as a keyboard and/or touchpad) may be used to interact with the computer 50, such as to start, control, or operate a GUI or applications running on the computer 50. For example, a keyboard and/or touchpad may allow a user to navigate a user interface or application interface displayed on the display 10.

As depicted, the electronic device 8 in the form of computer 50 may also include various input and output ports 12 to allow connection of additional devices. For example, the computer 50 may include an I/O port 12, such as a USB port or other port, suitable for connecting to another electronic device, a projector, a supplemental display, and so forth. In addition, the computer 50 may include network connectivity, memory, and storage capabilities, as described with respect to FIG. 1. As a result, the computer 50 may store and execute a GUI and other applications.

With the foregoing discussion in mind, it may be appreciated that an electronic device 8 in the form of either a handheld device 30 or a computer 50 may be provided with an OLED or LCD type of display 10. In any case, in a dark environment (i.e., low levels of ambient light), a user may see only the light emitted by the display 10. As the amount of ambient light striking the display 10 increases, some of the ambient light impinging on the display 10 may be reflected or scattered from the display 10 itself into the user's eyes. The sources of this reflected light may include the front surface of the display 10, any metallic or conducting layers within the display 10, interfaces within the display 10 in which the refractive index in one layer is different from the refractive index in the adjacent layer, and the like.

In embodiments in which the electronic device 8 includes an LCD, display 10 may include an array or matrix of picture elements (i.e., pixels). In operation, display 10 generally operates to modulate the transmission of light through the pixels by controlling the orientation of liquid crystal disposed at each pixel. In general, the orientation of the liquid crystals is controlled by varying an electric field associated with each respective pixel, with the liquid crystals being oriented at any given instant by the properties (strength, shape, and so forth) of the electric field. By varying the orientation of the liquid crystals, the display 10 may be capable of displaying colors in multiple gamuts of varying widths such as, for example the sRGB color gamut or the Adobe® color gamut.

Alternatively, the electronic device 8 may employ inorganic light emitting diodes or organic light emitting diodes (OLEDs) as the display 10. The OLED display may generate light in response to an electronic signal in contrast to the LCD display, which modulates the transmission of light through its pixels. In general, the OLED display may provide high contrast, bright colors, and fast response times since they are self-emissive. That is, the amount of light emitted from any subpixel in the OLED display depends on the current passing through the light emitting diode in that subpixel. As mentioned above, the OLED display may be designed to have an exceptionally large color gamut such that they can render more saturated colors than those colors specified by the sRGB color space. As such, the OLED display may be used to compensate for ambient light reflected off the display 10 by displaying the depicted images using its exceptionally large color gamut.

Additionally or alternatively, the display 10 may represent other types of display devices. For example, the display 10 may be a backlit electrophoretic display, a backlit electrowetting display, other type of particle-based display employing a backlight, a projection display, a plasma display, a field emission display, and the like, which may also be used to compensate for reflected ambient light in the manner disclosed. Moreover, the display 10 may even be a reflective display that may render color, and can be equipped with a front light such as an electrowetting display, a reflective LCD, an electrochromic display, an electrophoretic display, and the like, which may be used to compensate for reflected ambient light in the manner disclosed. Additional details with regard to varying the color gamut of the display 10 to compensate for colors distorted due to reflected ambient will now be discussed below with reference to FIGS. 4-7.

Figure 4:
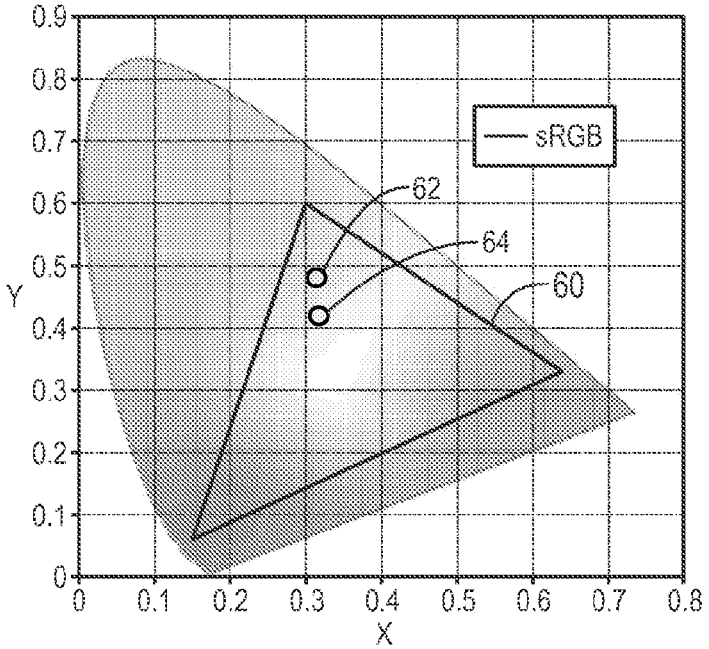
FIG. 4 illustrates an example of a smaller red, green, and blue (sRGB) color space in accordance with an embodiment.

Keeping the foregoing in mind, FIG. 4 illustrates a smaller RGB color space within a common color space triangle 60. As more ambient light reflects off the display 10, the color of an image depicted on the display 10 as seen by a human observer may move closer to the center of the common color space triangle 60. For instance, a specified green color coordinate 62 may move towards a less saturated hue (i.e., green color coordinate 64) due to ambient light reflecting off the display 10. The move towards the less saturated hue may be caused by the addition of white color from the reflected ambient light, which may compete with the colored light emitted from the display 10. In other words, the white color component added to every pixel in the depicted image may degrade the color accuracy of the depicted image, as observed by a user. As the saturation of the depicted color coordinate decreases, the image contrast depicted in the display 10 may also decrease, thereby making it difficult for a user to even discern the image depicted in the display 10.

Accordingly, in one embodiment, the color controller 28 may adjust or enhance the colors of images depicted in the display 10 to compensate for the ambient light reflected off the display 10. That is, the color controller 28 may adjust the colors depicted on the display 10 to enhance the colors of images in bright ambient light environments. By adjusting the colors depicted by the display 10 towards more saturated values, the resulting colors viewed by a user may become easier to discern. Moreover, by increasing the saturation of the color, the colors observed by the user will be closer to the intended values before the extra white coloration from the reflected ambient light is added.

Figure 5:
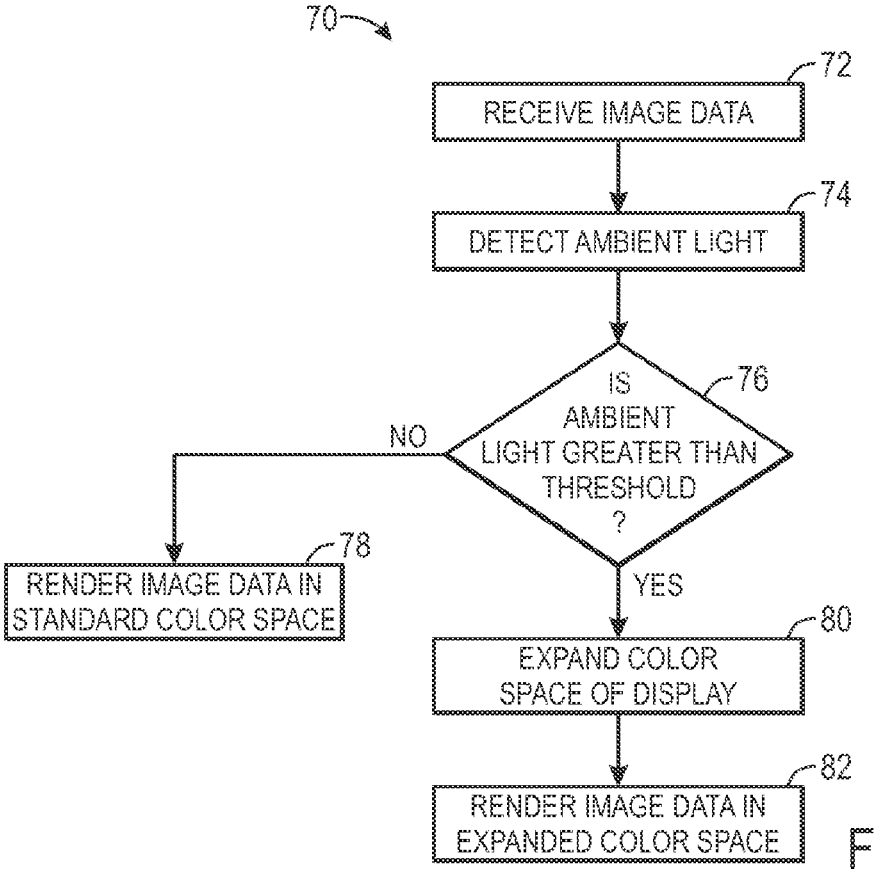
FIG. 5 is a flow chart that depicts an embodiment of a method for adjusting a color space of a display based on an amount of ambient light impinging on a display in accordance with an embodiment.

Keeping this in mind, FIG. 5 illustrates a method 70 for adjusting the colors of an image or images depicted in the display 10 based on an amount of ambient light impinging on the display 10. In one embodiment, the color controller 28 may perform the method 70, but it should be understood that the method 70 may also be performed by other components in the electronic device 8, such as the processor(s) 16 and the like.

Referring to FIG. 5, at block 72, the color controller 28 may receive image data that may be depicted on the display 10. The image data may include color coordinate values for each pixel in each frame of the images to be rendered on the display 10. In one embodiment, the image data may include color coordinate values within a first color space, such as the sRGB color space.

At block 74, the color controller 28 may detect an amount of ambient light impinging on the display 10. In one embodiment, the color controller 28 may receive ambient light measurements from the light sensors 22 or the camera 29. After receiving the ambient light measurements, at block 26, the color controller 28 may determine whether the received ambient light measurements are greater than a threshold ambient light measurement. Ambient light measurements greater than the threshold ambient light measurement may indicate that the electronic device 8 or the display 10 is operating in an environment with bright ambient lighting.

If the ambient light measurements are not greater than the threshold ambient light measurement, the color controller 28 may proceed to block 78 and render the image data in the first color space (e.g., sRGB) because the ambient light impinging on the display 10 may not be bright enough to distort the colors depicted in the display 10. If, however, the ambient light measurements are greater than the threshold ambient light measurement, the color controller 28 may proceed to block 80 such that the colors depicted in the display may be compensated for the effects of the ambient light reflecting off of the display 10.

Figure 6:
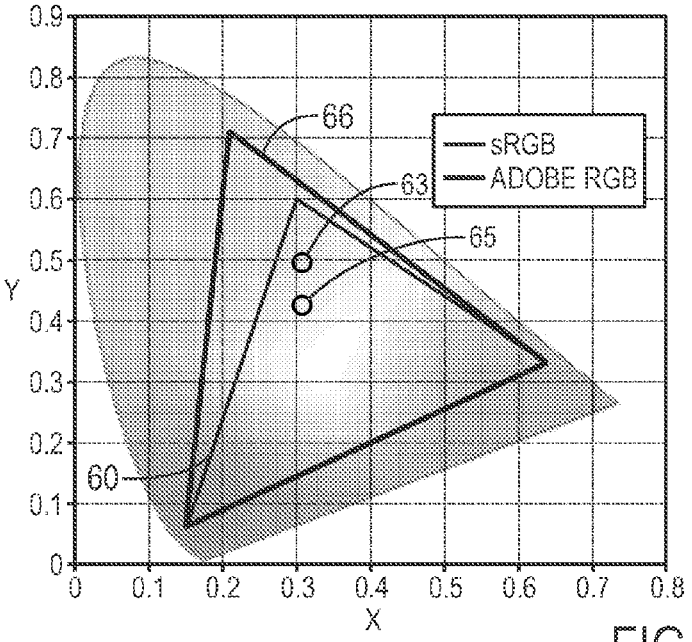
FIG. 6 illustrates an example of an expanded red, green, and blue (RGB) color space in accordance with an embodiment.

At block 80, the color controller 28 may expand the color space of the display 10 such that the display 10 is capable of rendering the image data in a wider color gamut, such as Adobe® RGB. As a result, the color controller 28 may compensate for the ambient light that may be reflecting off of the display 10 and may be distorting the colors of the images depicted in the display 10. FIG. 6 illustrates the wider color gamut available in the Adobe® RGB color triangle 66 as compared to the common color space triangle 60 introduced in FIG. 4. In general, all of the colors inside the wider Adobe® RGB color triangle 66 may be accessible to an OLED display.

In one embodiment, at block 80, the color controller 28 may expand the color space of the display 10 by a magnitude that is determined based on a function of the received ambient light measurements. For instance, the increase in the color space of the display 10 may be linearly proportional to an amount in which the ambient light measurement may exceed the threshold ambient light measurement. In another embodiment, the increase in color space may be a more complex function than being based on the difference. In yet another embodiment, the color controller 28 may access a look-up table that stores an expected white point of ambient light measurements. Using the expected white point of the ambient light measurements, the color controller 28 may adjust the color of each pixel to move away from the expected white point to compensate for the color distortion that may be caused by the ambient light.

At block 82, the color controller 28 may render the image data in the expanded color space, thereby compensating for color shifts in the depicted images caused by the ambient lighting. Namely, it may be recalled that a portion of the ambient lighting impinging on the display 10 may reflect off the display. The reflected ambient light may add whiteness to and de-saturate the image data depicted on the display 10. By rendering the image data in the expanded color space, the color controller 28 may shift the color (e.g., color coordinate 63) rendered by the display 10 away from the white portion of the color triangle of the display 10 (e.g., color coordinate 65). In a dark environment, this color shift would cause the image data to look unnatural. However, in a bright environment (i.e., high ambient lighting), the whiteness added to the image data by the reflected ambient light combined with the expanded color space moves the color of the image data depicted in the display 10 closer towards the color that was intended to be viewed. As such, the depicted image data appears more realistic in coloration than it would without the expanded color space.

In one embodiment, method 70 may be performed such that the threshold ambient light measurement at block 76 may be set to indicate extremely bright ambient light environments. In these extremely bright ambient light environments, the ambient light reflected by the display 10 may be so strong that the contrast of the display 10 may become degraded so much as to make the depicted image data difficult to discern.

In color science, a well-established principle known as the Helmholtz-Kohlrausch effect explains that the perceived brightness of highly saturated colors leads to an increase in perceived contrast. Keeping this in mind, at block 76, if the ambient light measurement received by the color controller 28 is greater than a threshold ambient light measurement that corresponds to an extremely bright ambient light environments (e.g., sunny day), the color controller 28 may expand the color space of the display 10 (block 80) to its maximum possible saturation levels. For example, the color controller 28 may be tuned so that the color depicted in the display 10 may be rendered without change at illuminance levels corresponding to building interiors (e.g., 500 lux or lower). Under somewhat brighter conditions (e.g., 1000 lux for overcast skies), the color controller 28 may expand the color space moderately. Further, under high brightness conditions (e.g., 10,000-25,000 lux for full daylight, or 32,000-130,000 lux for direct sunlight), the color controller 28 may expand the color space more aggressively. Accordingly, at block 82, the color controller 28 may depict the image data such that the colors of the image data are rendered at its maximum or near-maximum saturation levels. As a result, the depicted images may take advantage of the Helmholtz-Kohlrausch effect and become easier for a user to discern in extremely bright ambient light environments.

Although by depicting the image data such that the colors of the image data are rendered at its maximum or near-maximum saturation levels, the color controller 28 may not display the exact colors intended to be rendered. In bright ambient light environments, it may be nearly impossible to generate precise colors as perceived by the user. As such, depicting the image data such that the colors of the image data are rendered at its maximum or near-maximum saturation levels in these bright ambient light environments, the depicted image data in the display 10 may become at least discernible by the user, as opposed to indiscernible altogether.

In one embodiment, in addition to expanding the color space of the display 10, the color controller 28 may increase a gamma response of the display 10 to further enhance the perceived colors of the image data in high ambient light environments. In this case, the increased gamma response of the display 10 may increase the luminance difference between lower gray levels and higher gray levels in the depicted image data. Although this increase in the luminance difference between the lower gray levels and higher gray levels may reduce the contrast between the lower gray levels, in bright ambient light environments, these gray differences will be difficult to discern due to the amount of ambient light reflected from the display 10. As such, the user may not notice the reduced contrast at these low levels. Instead, the user may benefit from increased contrast between brighter gray levels.

In another embodiment, the color controller 28 may adjust a gamma curve used to depict the image data on the display based on a function of the ambient light measurements to further enhance the perceived colors of the image data in high ambient light environments. As such, the color controller 28 may adjust the gamma value in a continuous function based on the ambient light measurements. Alternatively, the color controller 28 may keep the gamma value constant until the ambient light measurements exceed a certain threshold. If the ambient light measurements exceed this threshold, the color controller 28 may then adjust the gamma value continuously or in increments as the ambient light measurements increase.

Figure 7:
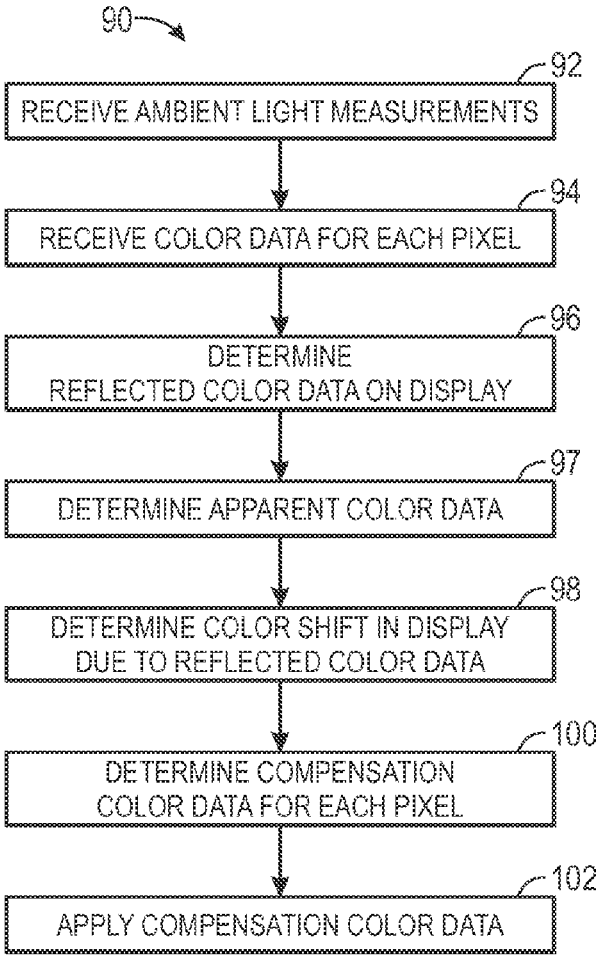
FIG. 7 is a flow chart that depicts an embodiment of a method for compensating an image rendered on a display for color shifts that occur due to ambient light impinging on the display in accordance an embodiment.

Referring back to block 82, in one embodiment, the color controller 28 may render the image data in the expanded color space based on the ambient light measurements and the color data for each pixel. FIG. 7 describes one example of a method 90 that may be used to determine and apply compensation factors to the image data based on the color data for each pixel in the image data and the ambient light measurements.

At block 92, the color controller 28 may receive the ambient light measurements from the light sensors 22 as described above in FIG. 5. At block 94, the color controller 28 may receive color data for each pixel in each frame of the image data. In one embodiment, the color data may be represented as International Commission on Illumination (CIE) Yxy coordinates. However, it should be understood that there are a number of different color systems and data formats that can be used to represent the color data.

Referring again to block 94, the color controller 28 may receive three Yxy variables (e.g., $Y_{source}$, $x_{source}$, and $y_{source}$) for each pixel in the image data. These Yxy variables may be derived from the source of the image data (e.g., application, program, etc.). Generally, the Yxy variables represent the intended luminance (Y) and color properties (x, y) of the image data as if they are displayed without the presence of a glare or light reflected from the various surfaces of the display 10. However, since ambient light may impinge on and reflect off the display 10, the actual color properties of the image data viewed by a user of the display 10 may not match the intended color properties of the image data.

Keeping this in mind, at block 96, the color controller 28 may determine reflected color data of the display 10 based on the ambient light measurements. Like the color data received at block 94, the reflected color data may be represented as Yxy variables ($Y_{ref}$, $x_{ref}$, and $y_{ref}$). In one embodiment, the actual amount of reflected ambient light may depend on the details regarding the construction of the display 10 and the amount of ambient light impinging on the display 10 (i.e., reflected ambient light). For instance, the amount of reflected ambient light may depend may a front surface of the display, any metallic or conducting layers within a module in the display, interfaces within the display 10 in which a refractive index in one layer is different from a refractive index in an adjacent layer, and the like. In some display designs, the amount of reflected ambient light may primarily be due to ambient light being reflected from the front glass or plastic face of the display 10, which may be approximately 4% of the incident light. In one embodiment, the amount of reflected ambient light may be predetermined based on the design of the display 10. As such, the amount of reflected ambient light may be used to determine a relationship between an amount of ambient light impinging on the display 10 and the reflected luminance level ($Y_{ref}$) of the Yxy variables.

Additionally, the color controller 28 may determine the values of $Y_{ref}$, $x_{ref}$, and $y_{ref}$, based on an intensity of the ambient light impinging on the display 10 (i.e., ambient light measurements) and/or the type of ambient light (e.g., as detected by the camera 29) impinging on the display 10. As such, in one embodiment, the color controller 28 may detect the actual intensity of the incident light and the x,y values for the incident light. For most situations, though, if the incident light is bright enough to affect the color of the image data depicted in the display 10, the color controller 28 may assume that the display 10 may be exposed to an outdoor ambient light source. Outdoor ambient light sources may be approximated by a D65 white point, which has x,y values of x=0.313, y=0.329. As such, if the color controller 28 assumes that the display 10 is exposed to an outdoor ambient light source, the color controller 28 may then assume that the reflected ambient light has the D65 white point x,y values.

In any case, the user of the display 10 may view a color and luminance from the display 10 that contains contributions from both the display 10 and the reflected ambient light. The color and luminance characteristics viewed by the user may be referred to as apparent color data. At block 97, the color controller 28 may determine apparent color data based on the contributions from both the display 10 and the reflected ambient light. The apparent color data may combine sets of luminance and color values (e.g., the combination of the source and reflected luminance and color sources) to yield an apparent ambient set of color values (e.g., $Y_{amb}$, $x_{amb}$, and $y_{amb}$). In one embodiment, the relative contribution of the source and reflected x and y values may depend on the relative luminance of the source and reflected light, as shown in the equations below:

$$Y_{amb} = Y_{source} + Y_{ref}; \tag{1}$$

$$x_{amb} = \frac{Y_{source}}{Y_{source} + Y_{ref}} x_{source} + \frac{Y_{ref}}{Y_{source} + Y_{ref}} x_{ref}; \tag{2}$$

and $$y_{amb} = \frac{Y_{source}}{Y_{source} + Y_{ref}} y_{source} + \frac{Y_{ref}}{Y_{source} + Y_{ref}} y_{ref}. \tag{3}$$

where $Y_{amb}$ refers to the ambient light's Y variable value of the ambient light's Yxy coordinates, $Y_{source}$ refers to the display's Y variable value of the display's Yxy coordinates, $Y_{ref}$ refers to the reflected light's Y variable value of the reflected light's Yxy coordinates, $x_{amb}$ refers to the ambient light's x variable value of the ambient light's Yxy coordinates, $x_{source}$ refers to the display's x variable value of the display's Yxy coordinates, $x_{ref}$ refers to the reflected light's x variable value of the reflected light's Yxy coordinates, $y_{amb}$ refers to the ambient light's y variable value of the ambient light's Yxy coordinates, $y_{source}$ refers to the display's y variable value of the display's Yxy coordinates, and $y_{ref}$ refers to the reflected light's y variable value of the reflected light's Yxy coordinates.

A measure of light incident on a surface of the display 10 may be referred to as illuminance, which may be measured in lux. Alternatively, the apparent brightness of the surface is the luminance or the surface luminance ($Y_{amb}$) may be measured in nits. The luminance of a highly reflective white surface is related to the ambient illuminance according to: Illuminance/$\pi$=Luminance. As such, $Y_{amb}$ may be derived by measuring the ambient illuminance, and dividing by $\pi$. In one embodiment, a lookup table may be used to reduce the amount of computation to determine $Y_{amb}$ for a given amount of light impinging on the display 10.

Keeping the foregoing in mind, and if a reflectivity coefficient (R) of the display 10 is known, the $Y_{ref}$ reflected color data variable may be determined according to: $Y_{ref}=Y_{amb}*R$. To reduce computational complexity, since the reflectivity coefficient (R) is a constant, then it's possible to combine the previous two equations as: $Y_{ref}$=Illuminance*R/$\pi$. Since the reflectivity coefficient (R) and $\pi$ are known constant quantities, these two terms can be combined in the calculation or $Y_{ref}$ may be estimated from a lookup table corresponding to a signal indicating an amount of light impinging on the display 10.

In one embodiment, under outdoor usage conditions, the color controller 28 may not measure $x_{amb}$ and $y_{amb}$ due to various complications and costs associated with respect to those measurements. Instead, the color controller 28 may simply measure the illuminance to determine $Y_{amb}$ and assume that $x_{amb}$ and $y_{amb}$ correspond to the color coordinates for typical daylight conditions such as D65. In another embodiment, a range ambient color coordinates ($x_{amb}$ and $y_{amb}$) may be user or machine selectable, depending on the viewing conditions or ambient light color temperature. In yet another embodiment, if the camera 29 is used to detect the ambient light, the color controller 28 may determine the values of $x_{amb}$ and $y_{amb}$ using the measurements from the camera 29 since the camera 29 may gave the capability of distinguishing between different colors of light.

At block 98, the color controller 28 may determine an apparent incremental color shift in the x and y coordinates due to the ambient light impinging on the display 10. The apparent incremental color shift may quantify the amount in which the displayed color gamut may have shifted due to the reflected ambient light. As such, the color controller 28 may use the apparent incremental color shift to compensate for the appearance of the image data depicted in the display 10 due to the ambient light impinging on the display 10. In one embodiment, the color controller 28 may determine the apparent incremental color shift in the x and y coordinates ($\Delta x_{inc}$ and $\Delta y_{inc}$) based on the following equations:

$$(x_{ref}-x_{source})=\Delta x_{inc} \tag{4};$$

and $$(y_{ref}-y_{source})=\Delta y_{inc} \tag{5}.$$

At block 100, the color controller 28 may determine color compensation data (e.g., Yxy variable values) based on the apparent incremental color shift. The color compensation data may include values that may be used to compensate for the incremental color shift determined at block 98. The color compensation data may be used to modify the luminance and color of the image data depicted in the display 10. As a result, the luminance of the display 10 may be increased by an amount equivalent to the reflected luminance with an incremental shift in color coordinates opposite of the reflected color shift. The incremental shift in color coordinates opposite of the reflected color shift for the x and y values (i.e., desired color shift) may be calculated based on the following equations:

$$-(x_{ref} - x_{source})\frac{Y_{ref}}{Y_{source}} = -\Delta x_{inc}\frac{Y_{ref}}{Y_{source}}; \tag{6}$$

and $$-(y_{ref} - y_{source})\frac{Y_{ref}}{Y_{source}} = -\Delta y_{inc}\frac{Y_{ref}}{Y_{source}}. \tag{7}$$

After determining the desired color shift, the color controller 28 may calculate compensation values ($Y_{comp}$, $x_{comp}$, and $y_{comp}$) for each pixel of the image data. The compensation values may enable the display 10 to render the proper color coordinates in various ambient light environments. In one embodiment, the compensation values for each pixel in the image data may have their own respective $x_{comp}$ and $y_{comp}$ values, but $Y_{comp}$ may remain the same for all pixels in the display 10. The compensation values ($Y_{comp}$, $x_{comp}$, and $y_{comp}$) may be determined based on the following equations:

$$\begin{aligned} x_{comp} &= \frac{Y_{source}}{Y_{source} + Y_{ref}} x_{source} + \frac{Y_{ref}}{Y_{source} + Y_{ref}}(-\Delta x_{inc}); \\ &= \frac{Y_{source}}{Y_{source} + Y_{ref}} x_{source} - \frac{Y_{ref}}{Y_{source} + Y_{ref}}(\Delta x_{inc}) \end{aligned} \tag{8}$$

-continued $$y_{comp} = \frac{Y_{source}}{Y_{source} + Y_{ref}} y_{source} + \frac{Y_{ref}}{Y_{source} + Y_{ref}} (-\Delta y_{inc}); \quad (9)$$

$$= \frac{Y_{source}}{Y_{source} + Y_{ref}} y_{source} - \frac{Y_{ref}}{Y_{source} + Y_{ref}} (\Delta y_{inc})$$

and $$Y_{comp} = Y_{source} + Y_{ref}. \quad (10)$$

Although the compensation values ($Y_{comp}$, $x_{comp}$, and $y_{comp}$) has been described as being calculated using the equations 8-10, it should be noted that the compensation values ($Y_{comp}$, $x_{comp}$, and $y_{comp}$) may also be determined from a look-up table indexed according to its $Y_{source}$, $x_{source}$, and $y_{source}$ values.

In another embodiment, at block 100, the compensation values ($Y_{comp}$, $x_{comp}$, and $y_{comp}$) may be determined using the equation described above for calculating the apparent incremental color shift. In this case, Equation 6 may be modified as shown below:

$$(x_{ref} - x_{source}) \frac{Y_{ref}}{Y_{source}} = \Delta x_{inc} \frac{Y_{ref}}{Y_{source}} = \Delta x_{inc} Y_{relative}. \quad (11)$$

Referring to Equation 11, $Y_{relative}$ represents the ratio of the reflected ambient light to the source luminance of the display 10. As such, it may be possible to generate an equivalent compensation by increasing $\Delta x_{inc}$ while decreasing $Y_{relative}$, or by decreasing $\Delta x_{inc}$ while increasing $Y_{relative}$. The type of compensation chosen may depend on various circumstances. For instance, for displays where many of the pixels are near saturation in color, the color controller 28 may not be able to choose a large magnitude for $\Delta x_{inc}$ or $\Delta y_{inc}$ and have $x_{comp}$ or $y_{comp}$ still lie in the range of colors that the display 10 can render. That is, the compensated x or y values may be more saturated than what the display 10 may be capable of depicting. In this case, the color controller 28 may choose a smaller value of $\Delta x_{inc}$ or $\Delta y_{inc}$, which may be paired with a larger Y value. In another embodiment, if maintaining low power is a primary consideration, then the color controller 28 may minimize the magnitude of $Y_{relative}$. In this way, a larger value of $\Delta x_{inc}$ may be chosen along with a smaller value of $Y_{relative}$. In yet another embodiment, the color controller 28 may assume that the values of $x_{ref}$, and $y_{ref}$ are constant for daylight ambient light environments. In this case, the color controller 28 may set these values to $x_{ref}$=0.313, $y_{ref}$=0.329 and perform the blocks 98 and 100 accordingly.

After determining the compensation color data, at block 102, the color controller 28 may apply the compensation color data to each pixel. As a result, the depicted image data in the display 10 may be perceived by a user to more accurately represent the intended colors of the image data despite the effects of ambient light reflecting off the display 10.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device, comprising:

a display configured to display one or more images;

a controller configured to adjust a color gamut of the display by:

receiving image data to be rendered on the display, wherein the image data comprises International Commission on Illumination (CIE) Yxy coordinates for each pixel in the image data;

receiving an ambient light measurement that indicates an amount of ambient light impinging on the display;

rendering the image data in a first color space when the ambient light measurement is less than a threshold; and rendering the image data in an expanded color space when the amount of ambient light is not less than the threshold by:

determining a shift in the Yxy coordinates for each pixel due to the amount of ambient light, wherein the shift in the Yxy variables for each pixel is determined according to:

$$(x_{ref} - x_{source}) \frac{Y_{ref}}{Y_{source}}$$

$$(y_{ref} - y_{source}) \frac{Y_{ref}}{Y_{source}}$$

wherein $x_{ref}$ corresponds to a reflected x variable of one or more reflected Yxy variables for each pixel due to the amount of ambient light, $x_{source}$ corresponds to an x variable of the Yxy coordinates, $y_{ref}$ corresponds to a reflected y variable of the reflected Yxy variables, $y_{source}$ corresponds to a y variable of the Yxy coordinates, $Y_{ref}$ corresponds to a reflected Y variable of the reflected Yxy variables, and $Y_{source}$ corresponds to a Y variable of the Yxy coordinates;

determining Yxy compensation variables for each pixel based at least in part on the shift in the Yxy coordinates for each pixel due to the respective reflected Yxy variables for each pixel; and applying the Yxy compensation variables to each pixel.

2. The electronic device of claim 1, wherein the image data rendered in the expanded color space are configured to compensate for a white color component added to the image data by the ambient light.

3. The electronic device of claim 1, wherein the controller is configured to render the image data in the expanded color space by increasing the color saturation levels of each color in the image data.

4. An organic light emitting diode (OLED) display device, comprising:

a controller configured to adjust a color space of the OLED display device based at least in part on an amount of light impinging on the OLED display device by:

receiving International Commission on Illumination (CIE) Yxy variables for each pixel in image data configured to be depicted on the OLED display device;

determining reflected Yxy variables for each pixel in the image data based at least in part on the amount of light impinging on the OLED display device;

determining a shift in the Yxy variables for each pixel due to the respective reflected Yxy variables for each pixel;

determining Yxy compensation variables for each pixel based at least in part on the shift in the Yxy variables for each pixel due to the respective reflected Yxy variables for each pixel, wherein the Yxy compensation variables are determined according to:

$$x_{comp} = \frac{Y_{source}}{Y_{source} + Y_{ref}} x_{source} - \frac{Y_{ref}}{Y_{source} + Y_{ref}} (\Delta x_{inc})$$

$$y_{comp} = \frac{Y_{source}}{Y_{source} + Y_{ref}} y_{source} - \frac{Y_{ref}}{Y_{source} + Y_{ref}} (\Delta y_{inc})$$

$$Y_{comp} = Y_{source} + Y_{ref}$$

wherein $x_{comp}$ corresponds to a compensation x variable of the Yxy compensation variables, $Y_{source}$ corresponds to a Y variable of the Yxy variables, $Y_{ref}$ corresponds to a reflected Y variable of the reflected Yxy variables, $x_{source}$ corresponds to an x variable of the Yxy variables, $y_{comp}$ corresponds to a compensation y variable of the Yxy compensation variables, $y_{source}$ corresponds to a y variable of the Yxy variables, $\Delta x_{inc}$ corresponds to a difference between a reflected x variable of the reflected Yxy variables and $x_{source}$, $\Delta y_{inc}$ corresponds to a difference between a reflected y variable of the reflected Yxy variables and $y_{source}$, and $Y_{comp}$ corresponds to a compensation Y variable of the Yxy compensation variables; and applying the Yxy compensation variables to each pixel.

5. The OLED display device of claim 4, wherein the shift in the Yxy variables for each pixel is determined according to:

$$(x_{ref} - x_{source}) \frac{Y_{ref}}{Y_{source}}$$

$$(y_{ref} - y_{source}) \frac{Y_{ref}}{Y_{source}}$$

wherein $x_{ref}$ corresponds to the reflected x variable of the reflected Yxy variables and $y_{ref}$ corresponds to the reflected y variable of the reflected Yxy variables.

* * * * *